US007469804B2

(12) United States Patent
Thiebaut

(10) Patent No.: US 7,469,804 B2
(45) Date of Patent: Dec. 30, 2008

(54) DYNAMIC DISPENSING DEVICE FOR A PRODUCT

(75) Inventor: Laure Thiebaut, Clichy (FR)

(73) Assignee: L'Oreal, Paris (FR)

( * ) Notice: Subject to any disclaimer, the term of this patent is extended or adjusted under 35 U.S.C. 154(b) by 471 days.

(21) Appl. No.: 11/070,880

(22) Filed: Mar. 3, 2005

(65) Prior Publication Data

US 2005/0230431 A1 Oct. 20, 2005

Related U.S. Application Data

(60) Provisional application No. 60/552,190, filed on Mar. 12, 2004.

(30) Foreign Application Priority Data

Mar. 3, 2004 (FR) ..... 04 50430

(51) Int. Cl.
*B67D 5/42* (2006.01)

(52) U.S. Cl. ..... 222/386; 222/542; 132/293

(58) Field of Classification Search ..... 222/386, 222/95, 93, 104, 213, 106, 214, 105, 78, 222/286.5, 388, 389, 542, 543, 97, 534; 132/293–296
See application file for complete search history.

(56) References Cited

U.S. PATENT DOCUMENTS

| | | | | |
|---|---|---|---|---|
| 2,106,629 | A * | 1/1938 | Cox | 222/386 |
| 2,500,687 | A * | 3/1950 | Kamp et al. | 222/48 |
| 3,563,414 | A * | 2/1971 | Coulombe et al. | 222/130 |
| 6,422,424 | B1 | 7/2002 | Sheffler | |

FOREIGN PATENT DOCUMENTS

| | | |
|---|---|---|
| DE | 591233 | 1/1934 |
| DE | 3100529 | 8/1982 |
| DE | 3726729 | 2/1988 |
| FR | 432977 | 3/1939 |
| FR | 852719 | 3/1940 |
| GB | 1050984 | 12/1966 |
| JP | JU-B S13-9968 | 7/1938 |
| JP | JU-B S46-34114 | 11/1971 |
| JP | JU-A S62-125768 | 8/1987 |
| JP | 2000-264384 | 9/2000 |
| JP | A 2000-264384 | 9/2000 |
| JP | A 2001-180768 | 7/2001 |

* cited by examiner

*Primary Examiner*—Lien T Ngo
(74) *Attorney, Agent, or Firm*—Oblon, Spivak, McClelland, Maier & Neustadt, P.C.

(57) ABSTRACT

A device for packaging and dispensing of a cosmetic product. The arrangement can be particularly advantageous for make-up and/or a skin care product, and includes a container forming at least one recess capable of accommodating the product. The recess has a first wall at least partially defining an inner surface of the recess, and a second wall rotationally movable relative to the first wall about an axis of rotation. The rotational movement of the second wall about the axis thereby causes a reduction of an angular difference defined between these two walls. The second wall presents a peripheral edge at least one portion of which is in leaktight engagement with the inner surface as it rotates about the axis. In addition, the second wall can delineate at least one outlet aperture to enable the product to be dispensed in response to the reduced angular difference. Preferably, the direction of the flow of the product being disposed is different from that of the axis of rotation.

34 Claims, 4 Drawing Sheets

DYNAMIC DISPENSING DEVICE FOR A PRODUCT

CROSS REFERENCE TO RELATED APPLICATIONS:

This document claims priority to French Application Number 04 50430, filed Mar. 3, 2004 and U.S. Provisional Application No. 60/552,190, filed Mar. 12, 2004, the entire contents of which are hereby incorporated by reference.

FIELD OF THE INVENTION

The invention relates to a dispensing pot for packaging and dispensing of products, and can be advantageous for products having a viscous consistency, such as products in the form of a cream, paste, ointment, balm, or gel. The invention is particularly suitable for packaging and dispensing products for cosmetic, dermatological or medical use, such as skin creams. The invention seeks in particular to facilitate dispensing of the contents of such pots.

BACKGROUND OF THE INVENTION

Discussion of Background

Containers in the form of a pot have been, and continue to be, widely used in the field of cosmetics and skin care. A pot is particularly well suited to the packaging of these products in that it allows ready access to the product contained therein, in particular when the product has to be taken up directly with the fingers. Furthermore, by virtue of the characteristically wide opening, it is possible to empty such receptacles completely or nearly completely, which is particularly desirable in the case of products having a high selling price to the consumer relative to the weight of the products.

One of the problems associated with a method of packaging and dispensing of this kind concerns the protection of the contents, particularly in relation to the ambient air, which is liable to adversely affect this type of product. Another problem relates to "contamination" of the product associated with such a method of taking up the product using the fingers. To address the latter problem, it has been proposed to take up the product using a spatula. However, this take-up method affords no protection of the contents from contamination of the spatula by the fingers or from contact with the air.

Another known method involves protecting the product by means of a disc covering the free surface of the product, with the disc having one or more openings arranged in a plane parallel to the plane of the disc, i.e. substantially perpendicular to the axis of the pot. In a general manner, dispensing of the product is achieved by depressing the disc into the pot, either by a simple sliding action according to the example given in document GB-A-1,050,984, or by imparting a rotating action in particular via a screw thread formed on the inner wall of the pot and capable of engaging with a corresponding screw thread formed at the periphery of the disc, according to the example given in document DE-A-37 26 729. The excess pressure exerted inside the pot imparts a flowing movement to the product such that it emerges through the opening(s) in the disc.

With such arrangements it is essential that the disc move strictly parallel to the rotational axis of symmetry of the pot to avoid leakage of product at the junction between the perimeter of the disc and the inner cylindrical walls of the pot. As more and more product is taken up, the disc is progressively drawn to the bottom of the pot. However, product take-up from the closure element at the bottom of the receptacle becomes less and less easy with repeated use.

Accordingly, arrangements have been proposed for existing pots in which the disc remains at a fixed height relative to the bottom of the pot, but in which the disc remains free to rotate in a groove in the pot. To allow the product to emerge, the disc is then equipped, as in the example described by document DE-A-31 00 529, with a wall extending into the pot so as to engage with a fixed panel in the pot thereby defining a chamber of variable internal volume as a function of the movement of this wall relative to the fixed panel. The product contained in this chamber can thus be compressed by the convergence of the wall relative to the fixed panel. This movement of the wall is obtained by rotation of the disc about an axis of rotation formed by a rotational axis of symmetry of the pot.

The product is then compressed so that it is dispensed at an upper face of the disc, assuming a flow parallel to this axis of rotation. In particular, the product flows inside the pot in two orthogonal directions, a first direction being given in a plane orthogonal to the axis of rotation, by virtue of this rotation of the wall relative to the fixed panel, and a second direction being given by the position of the outlet aperture in the disc. The product is therefore subjected to flows in different directions which can impair its chemical structure.

Document U.S. Pat. No. 6,422,424 describes a variant of the pot according to document DE-31 00 529 wherein the disc includes two walls extending orthogonally to the disc inside the pot, so that each cooperates with a separate fixed panel inside the pot. Thus the pot can be used to dispense two products each held in isolation in a chamber defined between one of the walls and one of the fixed panels. These two products respectively emerge via two openings in the disc. These openings are diametrically opposed, such that each is arranged in a part of the angular sector of the closure element that is in communication the longest with the chamber defined below this angular sector. However, a pot of this kind does not offer the possibility of packaging two products separately and subsequently enabling them to be simultaneously dispensed from one and the same aperture.

A rigid receptacle for dispensing a paste product under pressure is also known, as described in document FR-852, 719.

There is a need for pots having an advantageous design and which have a hygienic dispensing system. Preferably the pot should be simple to manufacture, and include a minimum of components so as to minimize manufacturing costs. In addition, there is also a need for a dispensing action different from the action required in manipulating the different pots of the prior art. Preferably, the dispensing action should not interfere with the physico-chemical structure of the product, which can be unstable in some instances.

SUMMARY OF THE INVENTION

The invention seeks to resolve at least one of the problems identified above by proposing a packaging and dispensing device which can be particularly advantageous for a cosmetic product, in particular make-up and/or a skin care product, including a container forming at least one recess capable of accommodating the product. In an illustrated example, the arrangement includes a recess having a first wall at least partially defining an inner surface of the recess, and a second wall rotationally movable relative to the first wall about an axis of rotation. The rotational movement of the second wall about said axis reduces an angular difference defined between these two walls, and the second wall presents a peripheral edge of which at least one portion is in leaktight engagement with the inner surface as it rotates about the axis. The second wall can delineate at least one outlet aperture to enable the product to be dispensed, in response to the reduced angular difference, in a direction of flow different from that of the axis of rotation.

Preferably, the container is designed so that when it is resting in a stable manner on a surface, manipulation of the second wall and the take-up of product can be performed with one hand.

Advantageously, the two walls respectively include two faces capable of being brought together at any point when the angular difference is minimal, so as to optimize emptying of the container.

Furthermore, by virtue of the fact that the product is contained in the recess, the product can preferably only be accessed via the outlet aperture, thereby limiting the risks of contaminating the product. When the second wall is caused to rotate relative to the first wall, the product is compressed in the recess so that it flows through this outlet aperture to be dispensed from the device.

By way of example, the outlet aperture is defined through the second wall at a distance from the edges of this wall. As a variant, it can emerge at a free edge of the second wall.

In particular, considering an opening in the recess delineated the edges of the walls delineating the recess, with an edge of the first wall partially delineating this opening for example, then the second wall is capable of at least partially closing off this opening.

In accordance with an advantageous example, the inner surface can be defined at least partially by a continuous surface formed by a plurality of mutually parallel circular arcs with respective centers along the axis of rotation. For example, these arcs can be mutually identical and capable of being superimposed on each other, so as to define with the first wall a volume delineating a portion of a cylinder. In this case, the two walls of the recess can be respectively defined by continuous surfaces formed by a plurality of connections between at least one point on each of these arcs and the axis of rotation. In particular, at least one of the two walls can be defined by a continuous surface formed by a plurality of radii with respective centers along the axis of rotation. Thus each connection between a point on an arc of circle and the axis of rotation corresponds to a radius.

In particular, at least one of the two walls, and preferably both walls, can be substantially flat.

In a first embodiment, the inner surface of the recess defines a portion of a sphere or spherical portion. For example, it may be defined in a quarter sphere or a half sphere.

In a second embodiment, the inner surface of the recess defines a portion of a cylinder, for example a quarter cylinder.

For example, one of the two walls may be fitted to the other of the two walls. For this purpose they may, for example, include means enabling them to be force fitted together. For example, lugs presented by the second wall can be provided to engage in counterpart slots provided in the container, and the axis of rotation of the hinge can pass through these lugs.

Alternatively, the two walls can be made directly from a single piece by molding. In this case, an axis of rotation can be formed at a film hinge defined at a junction between these two walls.

By way of example, the container can be made by injection molding. As a variant, one of the walls can be obtained by over-molding a first rigid structure, for example, made from polyethylene or polypropylene, with a second elastomer structure, and the elastomer structure delineating the edges of this wall. With such a structure, the manufacturing tolerances of the recess are taken up by the elastomer part which maintains leaktight contact and provides effective scraping of the rotationally mobile wall relative to the inner surface.

In a preferred embodiment, the device includes a holder capable of resting in a stable position on a surface. Preferably, this holder incorporates an opening at which the outlet aperture emerges, with one of the walls being accessible from this opening. The container can, for example, be clipped onto the holder. Alternatively, the holder can also take the form of a peripheral skirt surrounding the container, and the skirt can be formed simultaneously with the container during injection molding of the unit thus formed.

According to another advantageous aspect of the invention, an assembly is provided having two devices as previously described, with each device including one container, such that the respective containers of these two devices are arranged on either side of a partition. In this case, the two containers preferably can each cooperate with a separate flap (or a second wall for each container), with the two flaps each being rotatably mounted about its own axis of rotation, but integral with the partition. These two containers can be mutually symmetrical relative to a plane passing through this partition. Advantageously, the partition can include two facing flat surfaces. In this case, and where the two rotating flaps are each respectively mounted in cooperation with a container, the axes of rotation of these flaps can be mutually parallel. The two containers can be placed together so as to delineate a half-sphere. In this case, the flat surfaces on either side of the partition preferably extend in intersecting planes, such that the angular difference between these two flat surfaces is in the order of 5 to 15°, with each container then having a volume slightly less than a quarter of a sphere.

As should be apparent, the invention can provide a number of advantageous features and benefits. It is to be understood that, in practicing the invention, an embodiment can be constructed to include one or more features or benefits of embodiments disclosed herein, but not others. Accordingly, it is to be understood that the preferred embodiments discussed herein are provided as examples and are not to be construed as limiting, particularly since embodiments can be formed to practice the invention that do not include each of the features of the disclosed examples.

BRIEF DESCRIPTION OF THE DRAWINGS

The invention will become further apparent from the following detailed description, particularly when considered in conjunction with the drawings in which.

DETAILED DESCRIPTION OF THE PREFERRED EMBODIMENTS

Figure 1:
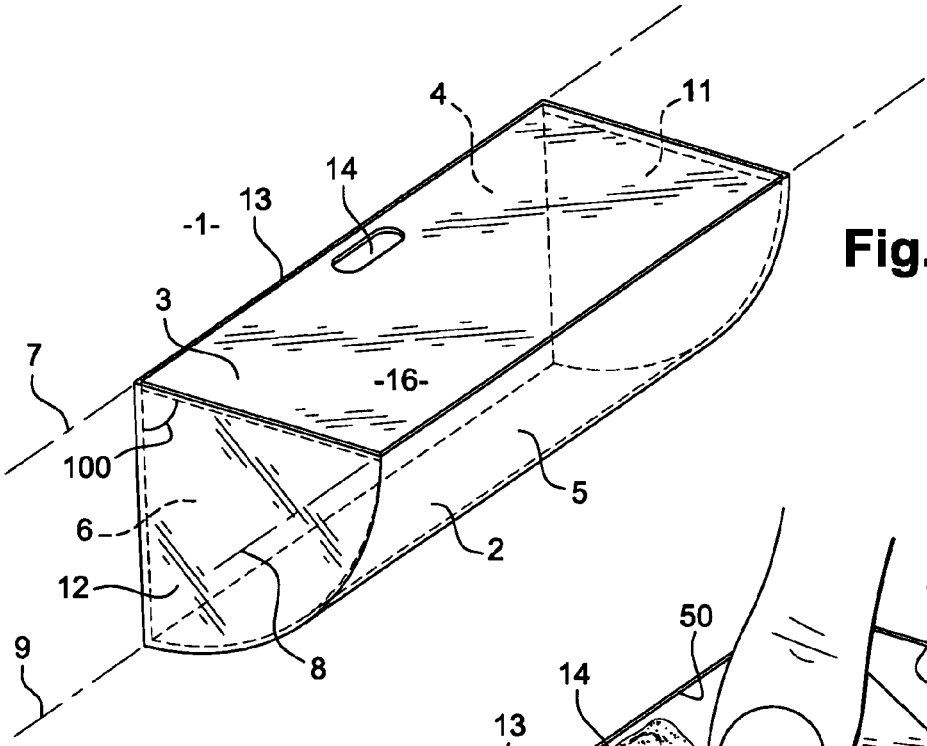
FIG. 1 is a profile or perspective view of a first embodiment of a device according to the invention.

FIG. 1 shows an example of a device 1 according to the invention. This device 1 includes a container 2 defining a recess 4 capable of holding a quantity of product to be packaged. An inner surface 5 of the recess 4 is delineated by at least one first wall 6, while a second wall 3 of the device 1 serves at least partially to close off the recess 4 in the container 2. The second wall 3 partly defines the external circumference of the device 1.

Figure 2:
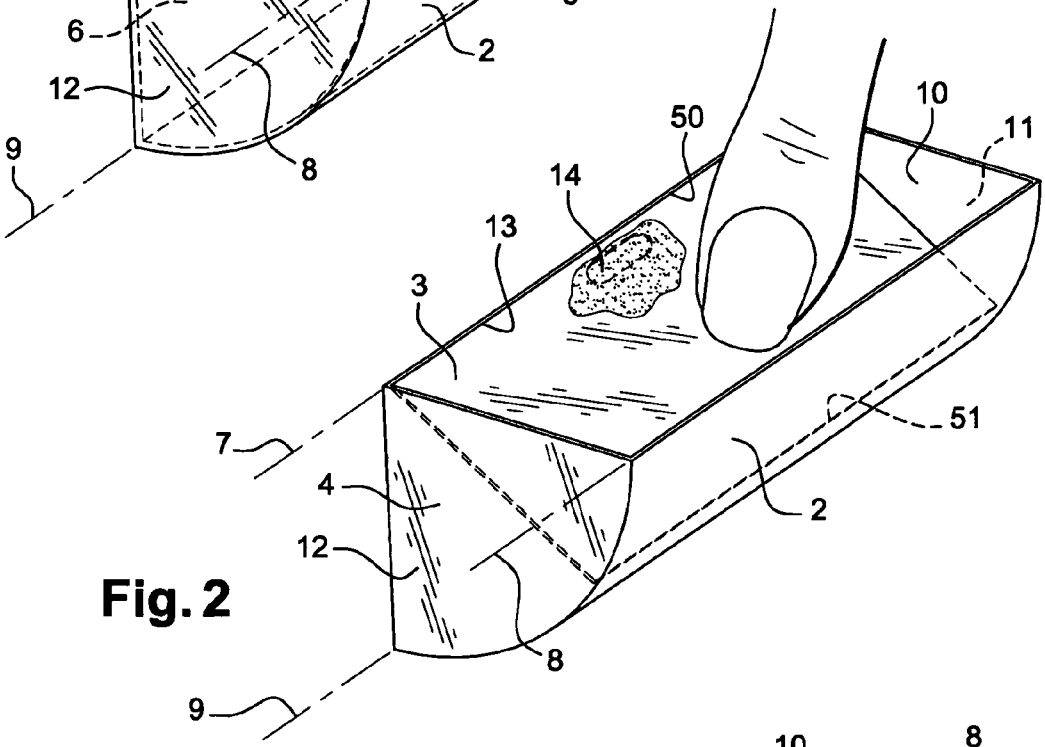
FIG. 2 is a profile view of a device according to the FIG. 1, in use.
Figure 3:
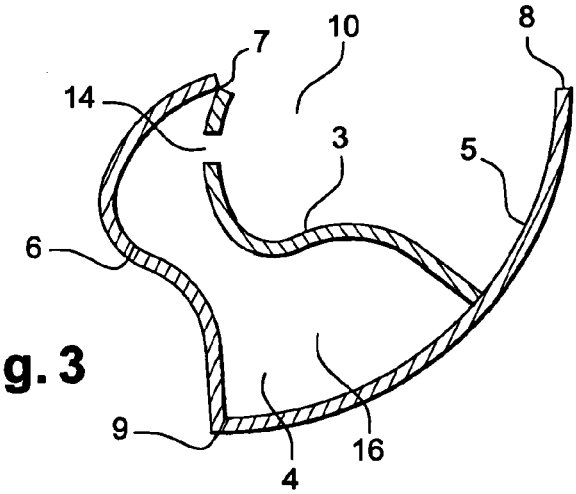
FIG. 3 is a sectional view of an alternative embodiment of a device according to the invention.

The inner surface 5 is defined by a continuous surface formed by a plurality of circular arcs. Each arc has a center arranged on an axis 7 also termed the axis of centers. In FIGS. 1 to 3, the circular arcs forming the inner surface 5 have the same angular opening, and the same radius. In addition, each arc is arranged so that the two respective ends of each of these arcs line up respectively along two lines 8 and 9. In FIG. 1 the lines 8 and 9 are identical and form two mutually parallel straight lines. In this first embodiment, depicted in FIGS. 1 to 3, the angular opening of these arcs of circle is 90°. Thus, as can be seen through the various examples in the drawing figures, the axis of rotation is substantially horizontal, and the product can be dispensed by a downward pressure applied to the second wall as the second wall pivots. As is also apparent from the examples of the drawings, the axis of rotation extends substantially horizontal. Moreover, the second wall can, for example, extend substantially horizontally prior to the first use, and become progressively inclined toward vertical as the product is dispensed.

The first wall 6 is defined by a continuous surface formed by a plurality of connections between at least one point on each circular arc and the axis of centers 7. Each connection is defined in a plane orthogonal to the axis of centers 7, so that this first wall 6 is also continuous.

In FIGS. 1 and 2, these connections are straight, mutually parallel and of the same length. The first wall 6 is then flat and is defined in a plane passing through the axis of centers 7. In FIG. 1, this first wall 6 passes through one of the lines passing through the ends of the arcs of circle, in this instance the line 9.

The second wall 3 is pivoted on the first wall 6 so that it can be caused to rotate about the axis of centers 7, also termed axis of rotation 7. An angular difference 100 defined between these two walls 3 and 6 varies as a function of the rotational movement of the second wall 3 relative to the other. For example, in FIGS. 1 to 3, the angular difference 100 is capable of varying in the range defined between 90° and 0°. As a variant, the second wall 3 may be suitable for covering an angular difference 100 relative to the first wall 6 greater than the angular opening of the inner surface 5.

In the examples depicted in FIGS. 1 to 15, the first wall 6 is integral with and partly forms the inner surface 5, the second wall 3 being arranged to rotate about the axis 7. The second wall 3 engages in a leaktight manner with the inner surface 5 of the recess as it moves in rotation about the axis 7. The second wall 3 therefore includes a linear edge 50 extending along the axis 7, and a second free outer edge 51 at which the second wall 3 comes at least partially into leaktight contact with the inner surface 5. The outline of this second free edge 51 is suitably shaped to cooperate with the inner surface 5.

The useful internal volume of the recess 4 is defined by the rotation of the second wall 3 about the axis 7 until the maximum angular opening of the inner surface 5 has been swept and/or until the second wall 3 comes into bearing contact against the first wall 6.

As a variant, not shown, the first wall 6 can also be movable relative to the inner surface 5, itself also being pivoted about the axis 7. Thus, a peripheral edge of this first wall 6 also engages with the inner surface 5 as it moves in rotation about the axis 7. The two walls 3 and 6 are then rotational about the axis 7.

The container 2 defines an opening 10. In FIG. 2, the opening 10 is delineated between the second straight line passing through the ends of the circular arcs, in this instance line 8, and the axis of centers 7. In this embodiment, as depicted in FIGS. 1 and 2, the inner surface 5 includes two lateral portions 11 and 12 extending orthogonally to the axis of centers 7 so that the recess 4 defines a cavity capable of holding a product such as a cream. These two lateral portions 11 and 12 define identical disc portions of an angular sector equal to or greater than the angular sector of the arc of circle portions of the inner surface 5. The cavity is then defined as a quarter of a cylinder, the height of which is defined along the axis of centers 7.

The opening 10 is partly closed off by the second wall 3. The product is arranged in the container 2, under this second wall 3. In the illustrated example, the second wall 3 in cooperation with the recess 4 defines a volume 16. The second wall 3 has an outlet aperture 14 through which the product contained in the volume 16 of the recess 4 can be dispensed. In fact, the volume 16 varies as a function of the movement of the second wall 3 relative to the recess 4 about the axis 7 with the product being compressed so as to flow through the outlet aperture 14 out of the device 1. The user presses directly on the external surface of the second wall 3, at the point where the outlet aperture 14 emerges.

The outlet aperture 14 is defined on the second wall 3. The emerging flow of product is then orthogonal to the wall presenting the outlet aperture 14. In the illustrated example, the walls 3 and 6 are rotational about the axis 7, with the axis 7 included in the thickness of these walls. The outlet aperture 14 necessarily passes through the thickness of the second wall 3, and it therefore orients a flow of product passing through it in a direction different from that of axis 7.

In this example, as depicted in FIGS. 1 to 3, the outlet aperture 14 is defined through the second wall 3. The outlet aperture 14 is preferably defined in the second wall 3 in the vicinity of a hinge 13. The presence of this outlet aperture 14 on the second wall 3 prevents the second wall 3 from completely closing off the opening 10.

As a variant, the outlet aperture 14 can be defined at the free peripheral edge 51 of the second wall 3 configured not to come into contact, at least locally when forming this aperture 14, with the inner surface 5, or with one of the lateral portions 11 and 12 as appropriate.

As shown in FIG. 2, when a user exerts pressure using at least one finger directly on the second wall 3, the second wall is caused to rotate about the hinge 13 formed about the axis 7, and as the peripheral edge 51 scrapes against the inner surface 5, and also in this instance against the lateral portions 11 and 12, the product is then concentrated in the recess 4 until the volume 16 is insufficient in relation to the volume of product remaining. The excess volume of product is then expelled via the outlet aperture 14, where the user can take it up directly with the finger. The second wall 3 is accessible from the outer surface of the device 1, and the pressure is exerted on the external surface of the second wall 3 in the same direction as the resulting movement of this second wall 3.

The second wall 3 in FIGS. 1 and 2 has a flat structure, and it is thus able to cooperate effectively with the first wall 6, which is also flat in FIGS. 1 and 2. In particular, to ensure maximum emptying of the container 2, the two walls 3 and 6 are applied against each other until only a very thin film of product remains between them that cannot be expelled from the outlet aperture 14. Initially, the second wall 3 is designed to come into contact with each of the circular arcs at the level of line 8, and then to pass across the entire inner curvature of these arcs in intimate contact therewith so as to ensure that the connection remains leaktight. This is why the second wall 3 is pivoted about an axis passing through the centers of each of these arcs.

As a variant, as shown diagrammatically on the sectional view in FIG. 3, the second wall 3 need not be flat, and in this instance it is chosen so that it is still able to cooperate effectively with the second wall 6. This second wall 6 is also not flat and provides a counterpart structure to that of the second wall 3.

Figure 11:
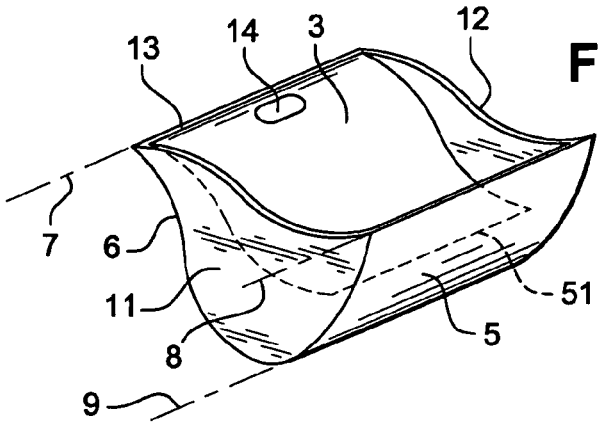
FIGS. 11 to 15 are profile views of alternative embodiments of a device and/or assembly according to the invention.

FIG. 11 shows a device according to the invention in which the two walls 3 and 6 have an undulating shape, superimposable, and attached at the level of the hinge 13 forming the axis of rotation 7. In the embodiments depicted in FIGS. 3 and 11, the inner surface 5 presents a structure forming a portion of a cylinder and in which the inner surface 5 includes lateral portions 11 and 12, with these portions being flat and preferably having two undulating and superimposable edges.

Preferably, the structure of the second wall 3 is defined so as to be able to fit against the first wall 6 at all points, thus ensuring an optimum yield. The term yield refers to the proportion of product delivered by such a device 1 relative to the total quantity of product contained therein. Thus there are preferably no residual pockets between the two walls 3 and 6, and all or substantially all of the product contained within the volume 16 can be expelled via the outlet aperture 14.

To this end, and in this case, both the second wall 3 and the first wall 6 are formed by a plurality of connections, each defined in a plane orthogonal to the axis of centers 7 such that the connections forming one of these walls 3 or 6, defined in the same plane, are superimposable, as illustrated in FIG. 3. These connections can form a curved shape.

In FIGS. 4 to 7 and 9, 10, 12 and 13, the second wall 3 presents a free edge 51 having no segment orthogonal to the axis 7, and the inner surface 5 does not then include any lateral portions such as 11 and 12.

Figure 4:
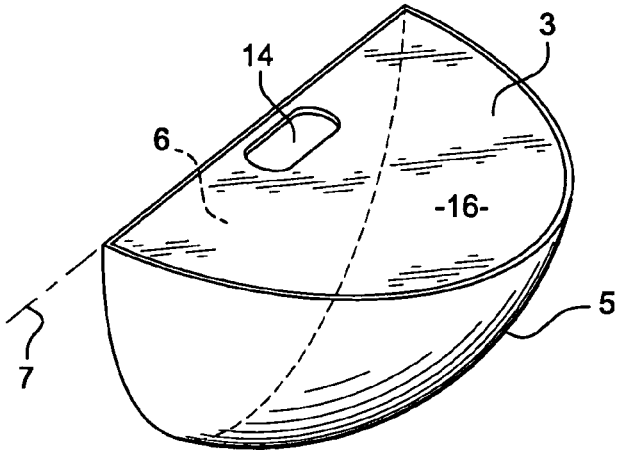
FIG. 4 is a profile view of a second embodiment of a device according to the invention.

In FIG. 4, the inner surface 5 presents a surface formed by a quarter sphere. In this example, the second wall 3 and the first wall 6 are identical in shape, preferably flat, and each respectively forms a half-disc of which the radius corresponds to the radius of the quarter sphere defining this inner surface 5. The outlet aperture 14 is here presented on the second wall 3. For example, the two walls 3 and 6 and the inner surface 5 can be made in a single piece and obtained by injection molding a thermoplastic material such as polyethylene or polypropylene. The second wall 3 is then molded in alignment with the first wall 6, such that a linear junction between these two walls 3 and 6 forms a line of reduced thickness along the axis of centers 7, thus forming the bending zone, or hinge 13, allowing the second wall 3 to rotate.

Figure 5:
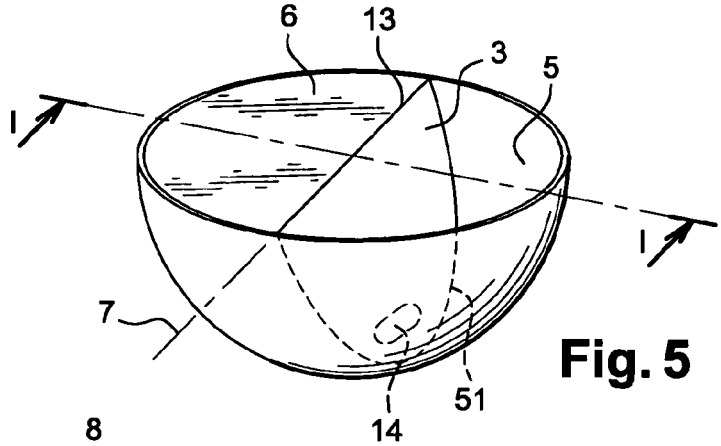
FIG. 5 is a profile view of a third embodiment of a device according to the invention.
Figure 6:
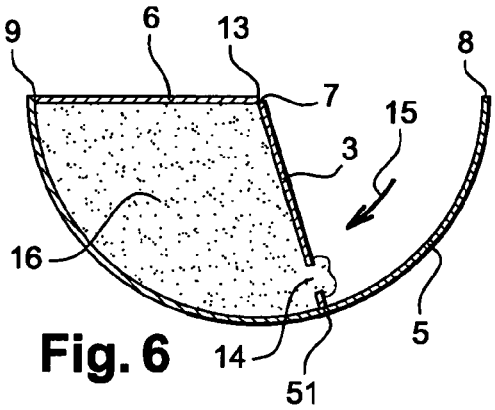
FIG. 6 is a sectional view of a device according to FIG. 5.

In FIGS. 5 and 6, the container 2 presents a recess 4 defined as a half-sphere. In this case, the inner surface 5 is molded separately in the form of a hemispherical cup. The second wall 6 can be molded with the first wall 3 in the shape of a disc such that one half of the disc is welded to the edges of the cup, and so that a film hinge delineates the edges of this half-disc welded to the cup. The film hinge is defined along a diameter of this disc so as to form two superimposable half-discs each respectively forming the walls 3 and 6. The second wall 3 is then rotatable about this hinge and can be caused to rotate inside the cup.

In this example, the cup can include on its inner surface two diametrically opposing lugs to support the second wall 6 when it is placed on the cup formed by the inner surface 5. These two lugs extend in the same plane as the edges of the cup. Preferably, the film hinge is arranged on these two lugs. In this case, the angular difference 100 can vary from at least 180° to 0° so as to progressively reduce the hemispherical volume 16.

In the sectional view depicted in FIG. 6, pressure exerted on the arrow 15 causes the second wall 3 to rotate about the film hinge 13 which is superimposed on the axis of centers 7. The product compressed in the recess 4, as the volume 16 diminishes, is therefore pushed through the outlet aperture 14. The peripheral edge 51 scrapes the inside circumference of the inner surface 5.

Figure 7:
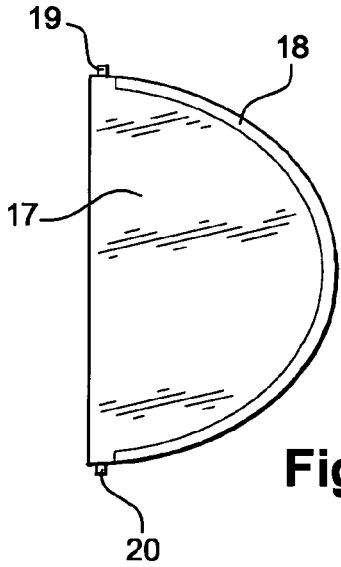
FIG. 7 is a top view of a device according to the invention.

In accordance with an example of an embodiment, at least the second wall 3 is obtained by over-molding a first rigid structure 17, for example made of polyethylene or polypropylene, with an elastomer material 18, with this elastomer material preferably forming the peripheral edge 51 in contact with the inner surface 5. The scraping action thus takes place in an optimum manner. As illustrated in FIG. 7, a second wall 3 thus over-molded and capable of being mounted on one of the containers according to FIGS. 4 to 6 is thus represented.

In accordance with one example, the second wall 3 (see FIG. 7) presents two diametrically opposing lugs 19 and 20 designed to engage with two counterpart slots presented by the inner surface 5 or the second wall 6, so as to form the hinge 13 about which the second wall 3 may be caused to rotate. The respective positions of the slots and lugs can be reversed. With either arrangement the two counterpart slots preferably are arranged on an axis corresponding to the axis of centers 7 of the inner surface 5.

Figure 12:
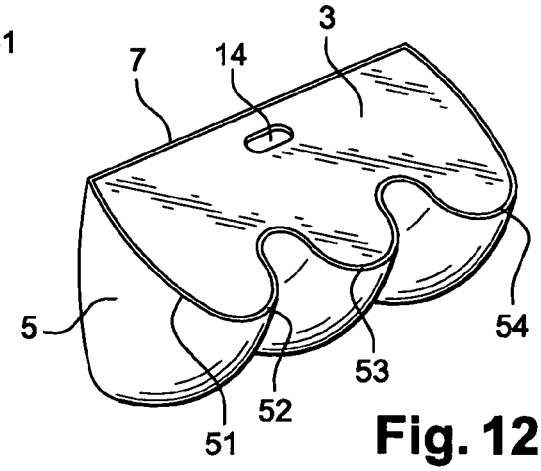

In FIG. 12, an alternative embodiment of a device 1 according to the invention includes a second wall 3 such that its peripheral edge 51 defines an irregular curve incorporating no segment extending orthogonally to the axis 7. In particular, the irregular curve in FIG. 12 includes three projections respectively 52, 53 and 54 extending orthogonally to the axis 7. In a complementary manner, the inner surface 5 takes the form of an irregular cup.

Figure 13:
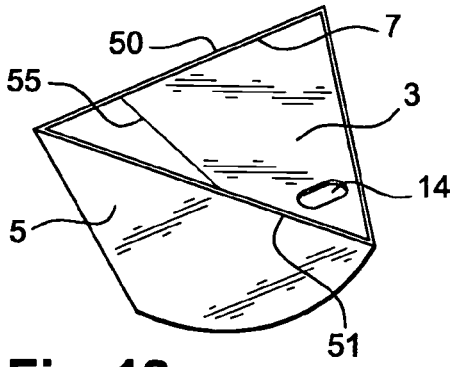

As a variant, as depicted in FIG. 13, the second wall 3 is triangular, with the peripheral edge 51 defining two sides of this triangle, and the third side forming a base 50 extending along the axis of rotation 7. In this example, the dispensing aperture 14 is located at a distance from the axis 7, at the apex defined by this triangle. Heights such as 55, orthogonal to the axis 7, respectively define radii for the corresponding arcs of circle and forming the inner surface 5.

Figure 8:
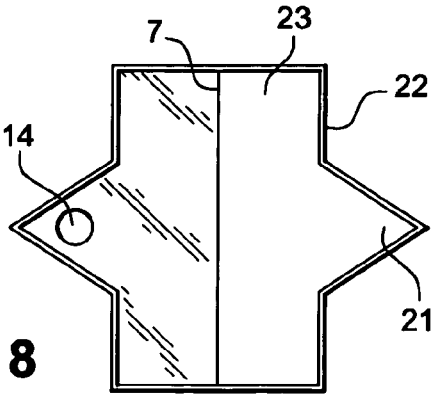
FIG. 8 is a top view of a variant of a device according to the invention.
Figure 14:
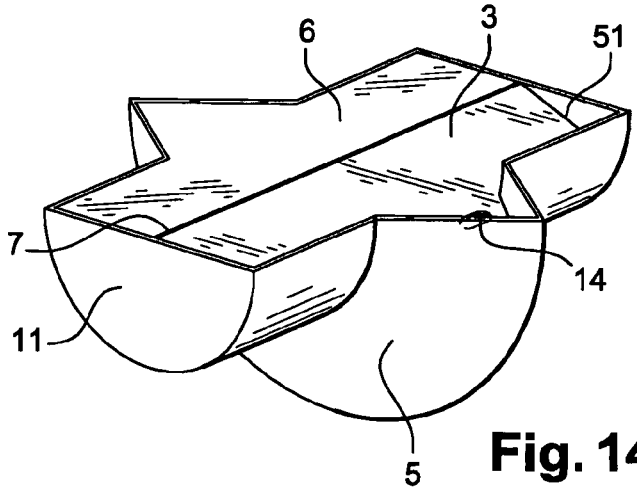

In FIGS. 8 and 14, an alternative embodiment of a container 2 created in the manner of the invention is shown. FIG. 8 depicts a top view of the container in FIG. 14. In this variant, the inner surface 5 has the shape of a cylinder portion, the cylinder portion having in addition a radial projection forming a ring portion with the same angular opening as the cylinder portion. In particular, and in lengthwise sectional view, this projection has a triangular cross-section 21 extending beyond an edge 22 of the cylinder portion 23.

In all the examples of the device according to the invention depicted in FIGS. 1 to 6, the container 2 always presents a substantially identical wall thickness, whether defining the inner surface 5 or the first wall 6. For this reason, a container 2 presents at least one curved outer wall in the preferred examples. Consequently, a device of this kind cannot necessarily be placed in a stable manner on surfaces such as shelves, with the outlet aperture 14 oriented upward so as to avoid leakage of product by gravity.

In order to place a device according to the invention in a stable manner on a surface, a container can be provided in which the thickness of the walls varies, so as to offer at least two intersecting flat faces on the outside of the inner surface 5.

Figure 9:
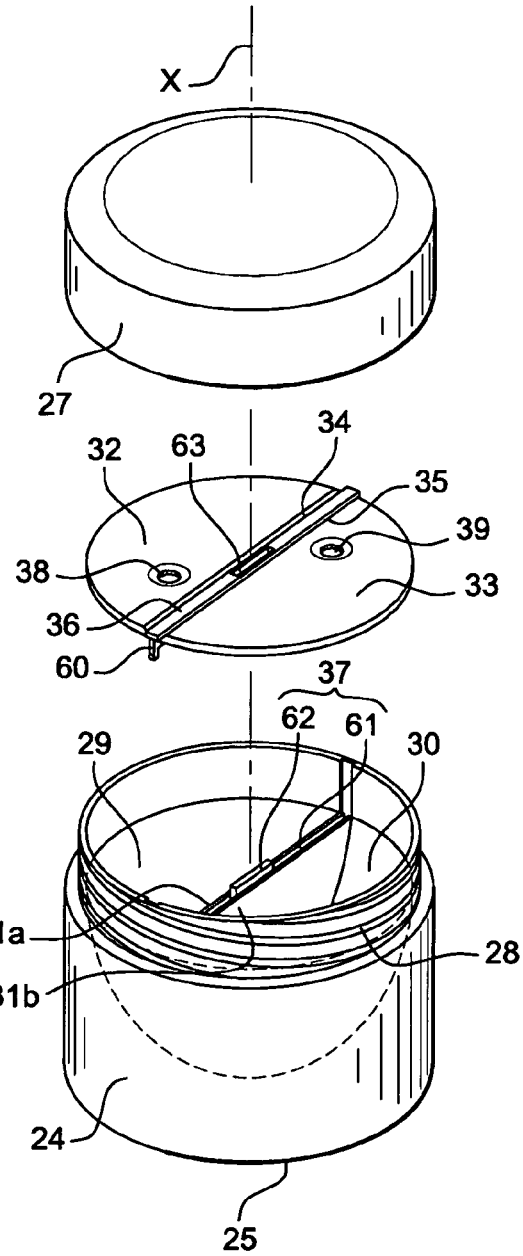
FIG. 9 is an exploded view of an assembly incorporating a device according to the invention.

Alternatively, the container 2 can be mounted in a holder 24. For example, as shown in FIG. 9, the holder 24 has a cylindrical structure including a base 25 on which it can rest in a stable manner. The holder 24 also includes an opening 26 through which the container 2 can be inserted into the holder 24. The opening 26 is parallel to the base 25 in the illustrated example. In the arrangement illustrated, the opening 26 extends orthogonally to a lengthwise axis X of the holder 24. For example, the container 2 includes an outer collar designed to engage with a counterpart projection on the inner circumference of the holder 24, in order to be retained in the holder 24.

In the example shown in FIG. 9, the holder 24 includes a cover 27 capable of closing off the opening 26. For example, this cover is configured so as to be screwed onto a thread 28 presented on the outer circumference of a neck delineating the opening 26.

Figure 10:
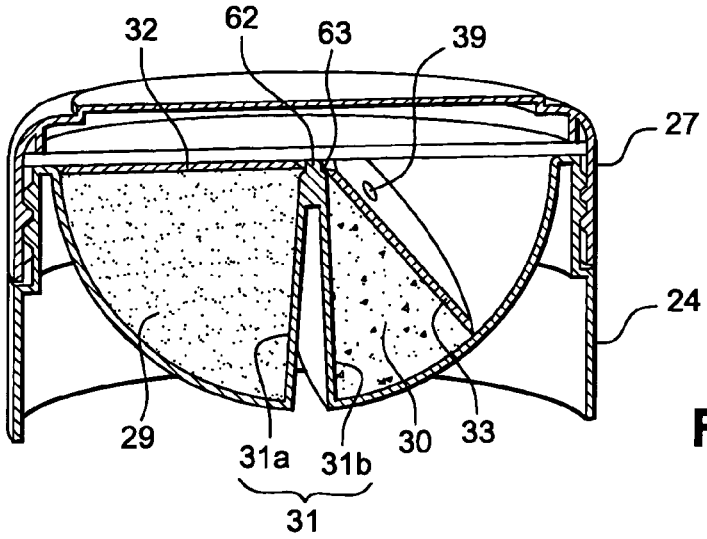
FIG. 10 is a sectional view of an assembly according to FIG. 9, after at least one use.
Figure 15:
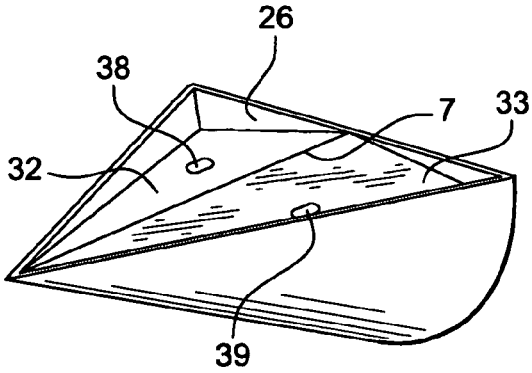

In particular, as shown in FIGS. 9, 10 and 15, a first container 29 and a second container 30 respectively such as 2 can be defined on either side of a partition 31. In this instance, each of the two containers 29 and 30 has a flap 32 and 33 respectively, forming the second walls such as 3. Each flap cooperates with the inner surface such as 5 of one of the containers. The partition 31 extends orthogonally to the planes of opening such as 10 of these two containers and to the opening 26. The two containers can be mutually symmetrical relative to a plane passing through the partition 31.

Preferably, the partition 31 includes two flat faces 31*a* and 31*b* forming the first walls such as 6 of each container. Each container 29 and 30 defines for example (FIGS. 9 and 10) a chamber forming a portion of a sphere, in this example substantially in the shape of a quarter sphere. The flaps 32 and 33 are then in the form of a half-disc, and are respectively each connected for example by a film hinge 34 and 35 respectively to a central strip 36 substantially equal in length to the inside diameter of each of the two containers 29 and 30.

This central strip 36 is intended to cooperate with a portion 37 of the partition 31, so as to ensure the retention of these flaps on their respective container, such that this cooperation is capable of withstanding the stresses subsequently applied thereto, in particular when the flaps are caused to rotate about their respective hinge in order to cause a product to flow from the containers. In the present example, the two hinges are mutually parallel. Preferably, the central strip 36 includes elastically deformable lugs such as 60 capable of snapping into counterpart slots such as 61 provided in the portion 37.

In particular, to strengthen the snap-on attachment, the portion 37 includes at least one pinion 62 engaged through a counterpart groove 63 formed in the central strip 36.

Preferably two different products are packaged in the two containers 29 and 30. For example, products can be arranged there which must only be mixed together a short time before they are applied, to prevent them from being mutually degraded. Advantageously, and insofar as the two products are intended to be mixed together before application, the outlet apertures 38 and 39 respectively on each of the flaps 32 and 33 are preferably arranged in the vicinity of the central strip 36. These outlet apertures 38 and 39 can be, for example, slightly offset relative to each other so as not to be mutually symmetrical relative to a plane passing through the partition 31, thereby avoiding any inadvertent contamination of the two containers.

Alternatively, as depicted in FIG. 15, if the two products are intended to be used quite separately, for example one during the day and the other at night, the two apertures can be arranged in the more central regions in their respective flap, thereby limiting the risk of the products emerging in proximity to one another.

As illustrated in FIG. 10, a user may have taken up product from a single side only, having depressed only one of the two flaps. The two hinges 34 and 35 can thus operate independent of each other. In this example, the user has already taken up product arranged under flap 33, whereas no product has yet been taken up from container 29.

In FIG. 15, the two flaps 32 and 33 are in the form, for example, of right-angle triangles inscribed within an opening 26 which is itself triangular, such that the axis of rotation 7 is orthogonal to a base of the isosceles triangle formed by this opening 26.

To fill packaging devices of this kind, the container is either filled before the second wall such as 3, 32 or 33 is placed on the container, or the recess 4 is filled while the second wall is already partly closing off the opening such as 10 of the container. In the latter case, the product can be introduced directly via the outlet aperture 14.

Throughout the description, expressions such as "including one," having, has, comprising, etc. should be regarded as synonymous with "including at least one", unless otherwise specified.

In the examples, the angular opening of the inner surface 5 is in the order of 90° or 180°, but this angular opening can have any value strictly less than 360°, and preferably equal to or less than 270°.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A device for packaging and dispensing a cosmetic product, comprising:

a first container and a second container, each of said first container and said second container including at least one recess capable of accommodating the cosmetic product, said recess having a first wall defining at least partially an inner surface of said recess, and a second wall rotationally movable relative to the first wall about an axis of rotation, the rotational movement of the second wall about said axis thereby causing a reduction in an angular difference defined between these two walls, wherein the second wall includes a peripheral edge at least one portion of which is in leaktight engagement with the inner surface as the second wall rotates about said axis, and wherein the second wall at least partially delineates at least one outlet aperture through which the cosmetic product is dispensed in response to the reduced angular difference, and wherein the cosmetic product is disposed in a direction of flow different from that of the axis of rotation; and a holder that holds said first and second container and that includes a neck that delineates an opening in said holder, wherein said two containers are arranged in said holder such that said second wall of said first container and said second wall of said second container are each accessible through said opening in said holder, wherein the first wall of the first container and the first wall of the second container are free of any outlet apertures.

2. A device according to claim 1, wherein said inner surface of at least one of said first container or said second container defines a portion of a sphere.

3. A device according to claim 2, wherein said inner surface of at least one of said first container or said second container includes a shape of a quarter sphere.

4. A device according to claim 1, wherein at least one of the first and second walls of at least one of said first container or said second container is substantially flat.

5. A device according to claim 1, wherein the second wall of at least one of said first container or said second container at least partially closes off an opening in the recess of the at least one of said first container or said second container.

6. A device according to claim 1, wherein the first and second walls of at least one of said first container or said second container in cooperation with the inner surface of the recess of the at least one of said first container or said second container define a chamber having a volume which varies in response to rotation of at least one of the first and second walls of the at least one of said first container or said second container, and wherein the outlet aperture of the second wall of the at least one of said first container or said second container provides an outlet for the chamber to dispense the cosmetic product.

7. A device according to claim 1, wherein the first and second walls of at least one of said first container or said second container respectively include faces capable of being brought together at at least one point when the angular difference is minimal, so as to optimize emptying of the recess.

8. A device according to claim 1, wherein the outlet aperture of at least one of said first container or said second container is defined at a distance from the peripheral edge of the second wall of at the least one of said first container or said second container.

9. A device according to claim 1, wherein the outlet aperture of at least one of said first container or said second container emerges at an edge of one of the walls of the at least one of said first container or said second container.

10. A device according to claim 1, wherein one of the walls of at least one of said first container or said second container is fitted to the other of the two walls of the at least one of said first container or said second container.

11. A device according to claim 1, wherein the first and second walls of at least one of said first container or said second container are connected by a film hinge.

12. A device according to claim 1, wherein at least one of said first container or said second container is an injection molded container.

13. A device according to claim 1, wherein one of the first and second walls of at least one of said first container or said second container is obtained by over-molding a first rigid structure with a second elastomer structure, wherein the elastomer structure delineates edges of the one of the first and second walls.

14. A device according to claim 1, wherein said holder which holds said first container and said second container is capable of resting in a stable position on a surface.

15. A device according to claim 1, wherein the outlet aperture of said second wall of each of said first container and said second container is accessible through said opening.

16. A device according to claim 1, wherein a partition is positioned between the two containers.

17. An assembly according to claim 16, wherein the two containers are mutually symmetrical relative to a plane passing through the partition.

18. An assembly according to claim 16, wherein the partition includes two flat facing surfaces.

19. An assembly according to claim 16, wherein the two containers are adjacent each other and delineate a half-sphere.

20. An assembly according to claim 16, wherein the second wall of each of the two containers each respectively form a separate flap, the two flaps each being rotatably mounted about its own axis of rotation integral with the partition.

21. An assembly according to claim 20, wherein the respective two axes of rotation of the two flaps are mutually parallel.

22. A device according to claim 1, wherein prior to a first use said second wall of at least one of said first container or said second container is substantially horizontal and said second wall becomes progressively inclined toward vertical as the cosmetic product is disposed through said at least one outlet aperture.

23. A device according to claim 1, wherein said second wall of said first container and said second wall of said second container can each be rotated in a direction toward the other to dispense the cosmetic product from the respective first container and second container.

24. A device according to claim 1, wherein said second wall of said first container and said second wall of said second container each have a shape of half of a disc, and wherein prior to a first use the second wall of said first container and the second wall of said second container are adjacent each other to together present a disc-shape.

25. A device for packaging and dispensing a cosmetic product, comprising:

a first container and a second container, each of said first container and said second container including at least one recess capable of accommodating the cosmetic product, said recess having a first wall defining at least partially an inner surface of said recess, and a second wall rotationally movable relative to the first wall about an axis of rotation, the rotational movement of the second wall about said axis thereby causing a reduction in an angular difference defined between these two walls, wherein the second wall includes a peripheral edge at least one portion of which is in leaktight engagement with the inner surface as the second wall rotates about said axis, at least one outlet aperture through which the cosmetic product is dispensed in response to the reduced angular difference, wherein said axis of rotation extends in a substantially horizontal direction, and wherein prior to a first use said second wall is substantially horizontal, and said second wall becomes progressively inclined toward vertical as said cosmetic product is dispensed from said container through said at least one outlet aperture; and a holder that retains said first container and said second container, said holder including an opening through which said second wall of said first container and said second wall of said second container are each accessible such that pressure exerted on said second wall of a respective one of said first container or said second container through said opening causes the cosmetic product to be dispensed through said at least one outlet aperture of the respective one of said first container or said second container, wherein said second wall of said first container and said second wall of said second container each respectively rotate in a direction toward one another to respectively dispense the cosmetic product from said first container and said second container, and wherein the first wall of the first container and the first wall of the second container are free of any outlet apertures.

26. A device according to claim 25, wherein said at least one outlet aperture of at least one of said first container or said second container includes an aperture extending through said second wall of the at least one of said first container or said second container.

27. A device according to claim 25, wherein said at least one portion of said peripheral edge of said second wall of at least one of said first container or said second container is curved.

28. A device according to claim 1, wherein said holder includes a includes a base that is substantially parallel to said opening in said holder.

29. A device according to claim 28, wherein said holder includes a cylindrical sidewall that extends from said base to said neck and that surrounds said first container and said second container.

30. A device according to claim 1, wherein said first container and said second container are isolated from each other.

31. A device according to claim 20, wherein said two flaps are each connected to a central strip that is substantially equal in length to an inside diameter of each of the two containers.

32. A device according to claim 31, wherein said central strip respectively retains said two flaps on a respective one of said two containers.

33. A device according to claim 25, wherein said first container and said second container are isolated from each other.

34. A device according to claim 25, wherein the cosmetic product in said first container is different from the cosmetic product in said second container.

* * * * *

UNITED STATES PATENT AND TRADEMARK OFFICE

CERTIFICATE OF CORRECTION

PATENT NO. : 7,469,804 B2
APPLICATION NO. : 11/070880
DATED : December 30, 2008
INVENTOR(S) : Laure Thiebaut It is certified that error appears in the above-identified patent and that said Letters Patent is hereby corrected as shown below:

Column 13, Claim 28, line 2, delete second occurrence of "includes a".

Signed and Sealed this

Twenty-fourth Day of March, 2009

JOHN DOLL
*Acting Director of the United States Patent and Trademark Office*

UNITED STATES PATENT AND TRADEMARK OFFICE

CERTIFICATE OF CORRECTION

PATENT NO. : 7,469,804 B2
APPLICATION NO. : 11/070880
DATED : December 30, 2008
INVENTOR(S) : Laure Thiebaut It is certified that error appears in the above-identified patent and that said Letters Patent is hereby corrected as shown below:

Column 13, Claim 28, line 18, delete second occurrence of "includes a".

This certificate supersedes the Certificate of Correction issued March 24, 2009.

Signed and Sealed this

Fourteenth Day of April, 2009

JOHN DOLL
*Acting Director of the United States Patent and Trademark Office*